US006321620B1

(12) United States Patent
Fabbro

(10) Patent No.: US 6,321,620 B1
(45) Date of Patent: Nov. 27, 2001

(54) ELECTRICAL CORKSCREW WITH DEPTH PENETRATION REGULATOR

(76) Inventor: Alberto Fabbro, Viale Udine, 36 - 33010 Cassacco (UD) (IT)

( * ) Notice: Subject to any disclaimer, the term of this patent is extended or adjusted under 35 U.S.C. 154(b) by 0 days.

(21) Appl. No.: 09/673,190

(22) PCT Filed: Apr. 12, 1999

(86) PCT No.: PCT/IB99/00644

§ 371 Date: Oct. 12, 2000

§ 102(e) Date: Oct. 12, 2000

(87) PCT Pub. No.: WO99/52809

PCT Pub. Date: Oct. 21, 1999

(30) Foreign Application Priority Data

Apr. 15, 1998 (IT) ..... UD98A0061

(51) Int. Cl.[7] ..... B67B 7/00
(52) U.S. Cl. ..... 81/3.2; 81/3.09
(58) Field of Search ..... 81/3.2, 3.09, 3.48

(56) References Cited

U.S. PATENT DOCUMENTS 4,637,283 * 1/1987 Bertram et al. ..... 81/3.2
4,766,780 * 8/1988 Sechen ..... 81/3.2
4,955,261 * 9/1990 Chiang ..... 81/3.2
5,079,975 * 1/1992 Spencer, Jr. ..... 81/3.2
5,095,778 * 3/1992 Bocsi et al. ..... 81/3.2
5,351,579 * 10/1994 Metz et al. ..... 81/3.2
5,367,923 * 11/1994 Fabbro ..... 81/3.9
5,372,054 12/1994 Federighi, Sr. .
5,503,047 * 4/1996 Brockington ..... 81/3.2
5,724,869 * 3/1998 May ..... 81/3.2
5,899,122 * 5/1999 Court ..... 81/3.2

FOREIGN PATENT DOCUMENTS 2649968 1/1991 (FR) .
2199813 7/1988 (GB) .

* cited by examiner

*Primary Examiner*—Joseph J. Hail, III
*Assistant Examiner*—Hadi Shakeri
(74) *Attorney, Agent, or Firm*—Stevens, Davis, Miller & Mosher, LLP

(57) ABSTRACT

A device to automatically removed the cork (11) from a bottle (12), comprising a first screw (41) suitable to screw into the cork (11) and rotation means (38) associated with the first screw (41) to make it selectively rotate and penetrate into the cork (11), there being regulation means (33, 45, 46) associated with the first screw (41) to regulate its penetrative travel into the cork (11) according to the length of the latter, and hence the cork (11) can also be removed only partly from the bottle (12).

18 Claims, 1 Drawing Sheet

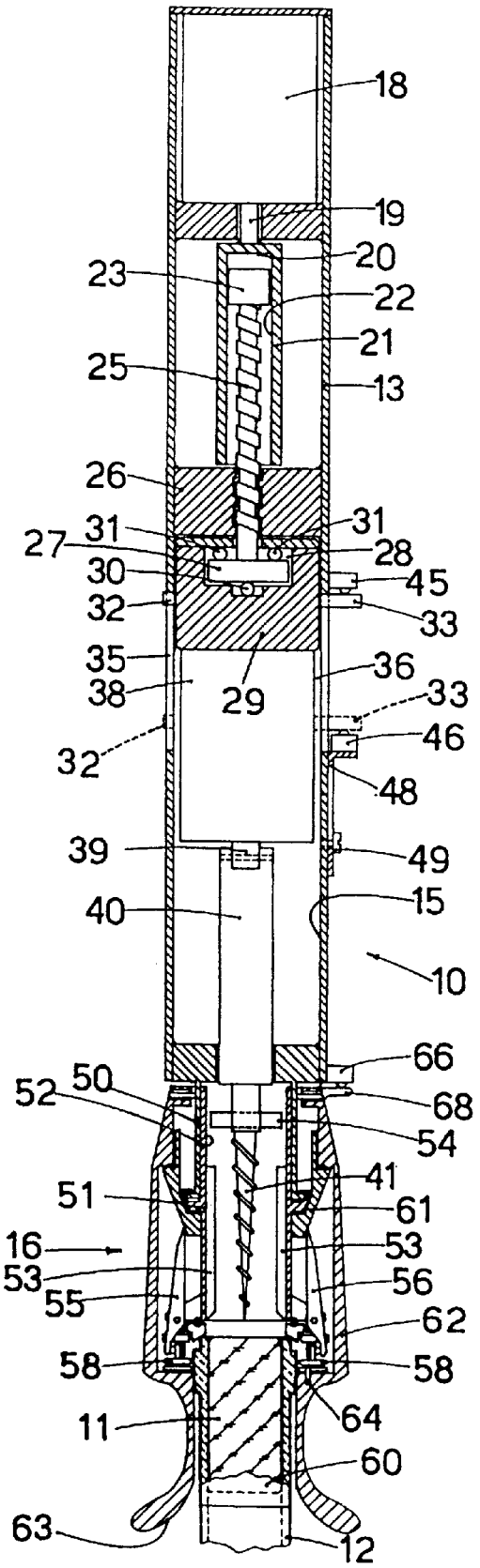
18
19
20
23
22
21
25
13
26
31
31
27
28
30
45
32
33
35
36
38
29
33
46
32
48
39
49
40
15
10
66
52
50
68
54
41
51
61
16
53
53
56
55
62
58
58
11
64
60
63
12

ELECTRICAL CORKSCREW WITH DEPTH PENETRATION REGULATOR

FIELD OF THE INVENTION

This invention concerns a device, provided with electric motors, to automatically remove corks from bottles, as set forth in the main claim.

To be more exact, the invention refers to a device which allows to automatically remove from a bottle both the cork, usually made of cork, and also the protective cap, usually made of metal or plastic material, wherein all the different steps are carried out by means of electric motors.

The device according to the invention is suitable to be used in any premises, either public or private, and is particularly suitable to be installed in public premises such as restaurants, inns, pubs or similar, where there is a frequent need to open bottles.

BACKGROUND OF THE INVENTION

In the state of the art, to remove the cork from a bottle the main steps are as follows: first the metallic or plastic protective cap (if any) which covers the cork must be removed; a self-threading screw is then made to penetrate into the cork until the thread has obtained a sufficient grip on the cork; the cork is then removed from the bottle, with a prevalently axial movement, with the help of one or more levers associated with one or more handles.

There are many corkscrews on the market which allow to carry out the above steps either manually or semi-automatically.

The most commonly used corkscrews are those operated manually; among them there is PCT N° WO-A-92/04273, of which the present Applicant is the Proprietor. This document discloses a corkscrew provided with a mechanism which allows to cut the protective cap when the screw is screwed into the cork, and then remove the part of the cap which has been cut together with the cork itself. This mechanism comprises a plurality of cutter wheels which are made to adhere to the cap by means of a system of levers activated by a sleeve which is made to slide axially with respect to the body of the corkscrew.

Even though it has solved a series of problems, this corkscrew still has the same disadvantages as all other manual corkscrews known to the art, that is, that all the operations have to be carried out by hand, with a considerable waste of time and energy on the part of the users, especially if they are restaurateurs or bartenders, or manage bars, pubs, inns or similar public premises, where such opening operations are frequently required.

There is also, in the state of the art, a device to remove corks wherein the screw, used to screw into the cork, is commanded by an electric motor. In this device the screw is laid on the upper part of the cork, the motor is fed electrically, so that the screw can turn and penetrate inside the cork, after which the motor is stopped. The device is then distanced from the bottle, until the cork has been removed. In this device, as the screw is not controlled in its travel, it normally penetrates the cork and completely perforates it, exiting through the inner end, with the disadvantage that it very often makes little pieces of cork fall inside the bottle and therefore into the content thereof, wine or other liquid whatever it may be.

Obviously, this is unacceptable, especially when the content is a valuable wine which must be served and drunk without any impurities.

U.S. Pat. No. 5,372,054 discloses an apparatus for automatically extract a cork from a bottle, wherein a corkscrew is associated to a reversible electric motor which, with a clockwise rotation, completely penetrates the cork, passing throughout thereof. In this apparatus the bottle neck is insertable into a tubular housing in which a tubular shuttle is axially slidable and the shuttle includes a stop to limit the insertion depth of the bottle neck. The electric motor, with its rotation in a clockwise direction, firstly causes the bottle neck and the shuttle to be pulled towards the stop position within the tubular housing, while the corkscrew penetrates into the cork, and then, when the shuttle and bottle neck are stopped causes a further penetration of the corkscrew into the cork and the extraction of the cork from the bottle neck, due to the auger effect of the corkscrew. The cork is withdrawn almost completely from the bottle neck, until the cork strikes a sensor. By reversing the motor, the counter-clockwise rotation of the corkscrew cause the push of the cork which does not rotate due to the presence of longitudinal ribs within the shuttle. This apparatus, even if allows to remove the cork almost completely from the bottle neck, has the drawback that the cork is always completed perforated by the corkscrew, so that little granulated parts of the same cork fall inside the bottle.

The present Applicant has devised and embodied this invention to overcome the shortcomings of the state of the art and to obtain further advantages.

SUMMARY OF THE INVENTION

The invention is set forth and characterised in the main claim, while the dependent claims describe other innovative characteristics of the main embodiment.

One purpose of the invention is to achieve a device to open a bottle, wherein it is easily possible to regulate the penetrative travel of the screw into the cork, so as to determine, in advance, before beginning the opening operation, how many millimetres the screw has to penetrate into the cork.

This allows to achieve two important and useful objectives: firstly to open the bottle only partly, and secondly to prevent the screw from completely perforating the cork.

The fact that it is possible to open the bottles only partly, keeping the corks partly inside the bottles, can be particularly useful when several bottles have to be prepared half-opened, for example before a banquet or a dinner with a large number of diners; in this case the bottles can be completely opened manually only when needed, at the last moment, in front of the diner himself, and in an extremely short time. This has considerable advantages both for hygiene and for the wine.

Another purpose of the invention is to achieve a device wherein all the different steps of opening the bottle are achieved automatically and quickly, without the user having to exert any physical force, either to tighten the screw into the cork or to remove the cork from the bottle, or to remove the cork from the screw.

A further purpose of the invention is to achieve a device to automatically remove the cork from a bottle and at the same time remove at least a portion of the protective cap which has previously been cut, again automatically.

In accordance with these purposes, the device to automatically remove the cork from a bottle comprises a screw suitable to be tightened into the cork and rotation means associated with the screw to make it selectively rotate and penetrate the cork. According to one characteristic of the invention, regulation means are associated with the screw to regulate its penetrative travel into the cork according to the length thereof, so that the cork can also be removed only partly from the bottle.

According to another characteristic, the penetrative travel of the screw into the cork is a few millimetres, advantageously between 6 and 12, less than the length of the cork.

According to another characteristic, a first electric motor is suitable to command the axial displacement of the screw and the regulation means comprise electric switching means associated with the electric motor to selectively command its start and stop.

According to a further characteristic, the rotation means for the screw comprise a second electric motor.

BRIEF DESCRIPTION OF THE DRAWING

These and other characteristics of the invention will become clear from the following description of a preferred form of embodiment, given as a non-restrictive example, with the help of the attached FIGURE which shows a longitudinal cross section of a device according to the invention.

DETAILED DESCRIPTION OF A PREFERRED FORM OF EMBODIMENT

With reference to the attached FIGURE, a device 10 to automatically remove the cork 11 from a bottle 12 comprises an upper tubular body 13, substantially cylindrical in shape and provided internally with a cavity 15, and a lower assembly 16 suitable to couple selectively with the neck of the bottle 12 which is to be opened.

In the upper part of the cavity 15 of the tubular body 13, a first electric motor 18 is fixedly mounted, with its rotation shaft 19 facing downwards and keyed onto an upper part 20 of a tube 21, provided with an inner cavity 22 with a substantially square cross section.

Inside the tube 21 there is a block 23 which also has a substantially square cross section, and which is suitable to slide axially with respect to the tube 21.

The upper part of a screw 25 is attached to the block 23; the screw 25 is constantly engaged with a corresponding nutscrew or lead nutscrew 26 mounted stationary inside the cavity 15.

The lower part of the screw 25 is solid with an element 27, substantially cylindrical in shape, which is free to rotate inside a cylindrical seating 28 made in a cylindrical block 29, assembled axially sliding inside the cavity 15.

In the seating 28, below the element 27 and in a central position, there is a bearing 30, while a plurality of bearings 31 are arranged between the element 27 and the upper part of the cylindrical block 29, in order to reduce to a minimum the friction between the element 27, which can rotate, and the block 29, which can only slide axially together with the screw 25.

The block 29 is provided with two lateral fins 32 and 33, arranged on diametrically opposite sides, which are inserted inside two corresponding longitudinal slits, respectively 35 and 36, made on the tubular body 13.

Inside the cavity 15, and attached to the block 29, there is a second electric motor, identical to the motor 18; the second motor 38, however, can slide axially with respect to the tubular body 13, unlike the motor 18 which is fixed.

The shaft 39 of the motor 38 is keyed to a cylindrical rod 40, at the lower end of which there is in turn attached a screw 41, with a tapered, self-threading shank, suitable to screw selectively into the cork 11.

According to one characteristic of the invention, the fin 33 is suitable to cooperate with two micro-switches 45 and 46, assembled on the outer part of the tubular body 13.

To be more exact, the first micro-switch 45 is assembled stationary, directly on the body 13, above the fin 33, so that it is driven by the latter when the block 29 and the motor 38 are displaced upwards, to the upper end of their travel, as will be explained in more detail later.

The second micro-switch 46 is assembled on a supporting bracket 48, assembled below the fin 33, sliding on the body 13 and able to be selectively clamped at a variable height by means of a clamping knob 49 which can be screwed onto the body 13.

The micro-switch 46 is suitable to be actuated by the fin 33 when the block 29 and the motor 38 are displaced downwards, to the lower end of their travel, as will be described in more detail later.

The motors 18 and 38 are fed advantageously with low tension direct current, for example 24 volt, by means of a feeder-straightener, of a known type and not shown in the drawing, connected to the electric supply network.

The lower assembly 16 is of a known type, for example of the type described in the Italian patent n°. 1.274.318, filed on Jan. 27, 1994 by the present Applicant and granted on Jul. 17, 1997. The description of the assembly 16 from the above Italian patent is summarised here, so that the invention can be more easily understood.

The assembly 16 comprises a lower appendix 50, internally hollow and attached to the lower part of the tubular body 13, and an element 51, also tubular, assembled rotatable inside the appendix 50.

The tubular element 51 defines a central cylindrical cavity 52 at the centre of which is accommodated the screw 41; it is provided internally with four vertical ribs 53, at an equal angular distance from each other and protruding towards the inside of the cavity 52. The ribs 53 are suitable to retain the cork 11 when it is removed from the bottle 12.

A transverse pin 54, mounted on the upper part of the screw 41, is suitable to cooperate with the ribs 53 to make the tubular element 51 rotate selectively.

On the lower end of the tubular element 51, on diametrically opposite sides, two levers 55 and 56 are pivoted, and cooperate, in the lower part, with cutter wheels 58 suitable to selectively cut the cap 60 which usually surrounds the neck of the bottle 12.

The upper ends of the levers 55 and 56 cooperate with a conical element 61, which is axially sliding with respect to the tubular element 51 and can rotate therewith.

A substantially cylindrical sleeve 62 is assembled outside the appendix 50 and can slide with respect thereto only in an axial direction.

The sleeve 62 is provided with a lower mouth 63 and is connected to the conical element 61 to command the axial sliding thereof with respect to the tubular element 51.

A vertical pin 64 is assembled on the sleeve 62 to cooperate with the lower part of the tubular element 51 and to selectively prevent the latter from rotating in an anti-clockwise direction.

According to one characteristic of the invention, a third micro-switch 66 is attached to the lower end of the tubular body 13 and is suitable to cooperate with a lateral fin 68 of the sleeve 62 when the latter is displaced upwards, to the upper end of its travel, as will be described in more detail later.

The device 10 is suitable to be attached vertically to a stationary wall, by any known attachment means.

The device 10 as described here functions as follows:

In the inactive position the screw 25, the block 29, the motor 38, the screw 41 and the sleeve 62 are all displaced upwards, as shown in the attached FIGURE.

In order to automatically pull the cork 11 of the bottle 12 and at the same time remove the upper part of the cap 60, the bottle 12 itself is inserted from the bottom into the mouth 63 of the sleeve 62.

The sleeve 62 is then made to slide axially downwards, causing, in a known manner, the conical element 61 to be lowered; in turn, by means of the levers 55 and 56, the conical element 61 takes the cutter wheels 58 towards the cap 60 until they cut it, as described in the afore-mentioned Italian patent n. 1.274.318.

Lowering the sleeve 62 also causes the micro-switch 62 to open, which thus activates the simultaneous feed of the two electric motors 18 and 38.

The stationary motor 18 makes the shaft 19 rotate in a clock-wise direction; it also makes the tube 21 rotate, and with it the block 23 and the screw 25. The latter, being engaged with the nutscrew 26, which is stationary, screws onto the nutscrew 26 and is displaced axially downwards.

Consequently, the block 29, the movable motor 38, the rod 40 and the screw 41 are also displaced axially downwards.

At the same time as this axial displacement takes place, the motor 38 makes the rod 40 and the screw 41 rotate in a clock-wise direction; the screw 41 thus screws into and penetrates the cork 11.

The transverse pin 54, rotating and descending downwards with the screw 41, after a few millimetres of its travel begins to interfere with the vertical ribs 53, thus making the tubular element 51 rotate also and with it the cutter wheels 58 which cut the circumference of the upper part of the cap 60.

When the fin 33 of the block 29 descends, it activates the lower micro-switch 46 (position shown in the FIGURE with a line of dashes), the lower motor 38 is stopped and, simultaneously, the direction of rotation of the shaft 19 of the upper motor 18 is inverted.

As we have seen, the travel of the fin 33 and therefore of the screw 41 can be regulated at will, according to the height of the cork 11 to be pulled and according to how much the cork 11 has to be removed from the bottle 12 (completely or partly, according to the user's requirements), without ever completely perforating the cork 11.

The micro-switch 46 in fact can easily be positioned at a variable distance, for example between 35 and 60 mm from the fin 33 in the inactive position, by operating on the knob 49. The distance set can also be displayed by means of a graduated scale, not shown in the drawings, located in correspondence with the bracket 48.

When the rotation of the shaft 19 is inverted, this causes the screw 25 to turn in an anti-clockwise direction, and consequently the block 29 is axially displaced upwards, as is the motor 38 and the screw 41 which, since it does not rotate, pulls the cork 11 upwards too, after having cut the upper part of the cap 60.

The fin 33, when it again reaches its inactive position, activates the micro-switch 45 which stops the upper motor 18.

The sleeve 62 is then made to return upwards manually, to the inactive position, where with its fin 68 it again activates the micro-switch 66, which causes the lower motor 38 to start in the opposite direction; in turn, the lower motor 38 makes the screw 41 rotate in the opposite direction, that is, anti-clockwise, which thus causes the cork 11 to be unscrewed and then expelled from the vertical ribs 53.

After a few seconds, a timer, of a known type and not shown in the drawings, makes the lower motor 38 stop too.

It is obvious that modifications and/or additions can be made to the device to automatically open bottles as described heretofore, but these shall remain within the field and scope of the invention.

For example, instead of the micro-switches 45, 46 and 66, it is possible to use other electronic devices which allow to set the travel of the screw 41 and to display it on a display.

What is claimed is:

1. A device to automatically remove, at least partially, a cork having a defined length from a bottle, comprising:

a first screw able to penetrate a determined amount into the cork;

rotation means associated to said first screw to make said first screw selectively rotate and penetrate into the cork;

manually operable regulation means associated to said rotation means for defining said determined a mount of penetration of said first screw into the cork, according to the length of the cork in such a manner that the determined amount is less than the defined length of the cork, for avoiding that the cork is completely perforated by said first screw; and extraction means connected to said first screw for causing the axial movement of said first screw and of the cork associated thereto from the bottle;

wherein said manually operable regulation means are also able to be set for obtaining an axial displacement of the cork from the bottle which amount is less than said defined length of the cork.

2. The device as in claim 1, wherein the penetrative travel of said first screw into the cork is a few millimetres less than the length of the cork.

3. The device as in claim 1, wherein said rotation means comprises a first electric motor connected to said first screw to command axial displacement thereof.

4. The device as in claim 3, wherein said regulation means comprises electric switching means associated with said first electric motor to selectively stop and start said first electric motor.

5. The device as in claim 3, wherein said rotation means comprises a second electric motor.

6. The device as in claim 5, wherein said first and second electric motors are two-directional, wherein said second motor is able to make said first screw rotate in a determined direction during a simultaneous axial displacement of said first screw towards the cork by means of said first motor, so as to cause said first screw to screw into the cork, wherein preventing means are provided to prevent rotation of the cork once at least partially removed from the bottle, and wherein said second motor is able to make said first screw rotate in a direction opposite to said determined direction, while said first motor is stationary, so as to cause the cork to be expelled from said first screw and said preventing means.

7. A device to automatically remove a cork from a bottle, comprising:

a first screw able to screw into the cork and rotation means associated to said first screw to make said first screw selectively rotate and penetrate into the cork, wherein regulation means are associated to said rotation means for regulating penetration travel of said first screw into the cork according to length of the cork for avoiding said cork being completely perforated by said first screw, said regulation means being also able to be set for obtaining also partial removal of the cork from the bottle;

wherein said rotation means comprises a first electric motor connected to said first screw to command axial displacement thereof;

wherein said rotation means comprises a second electric motor; and wherein said first motor is able to command axial displacement of said second motor by connection means connected to a shaft of said first motor.

8. The device as in claim 7, wherein said connection means comprises a screw-nutscrew mechanism comprising a second screw and a nutscrew.

9. A device to automatically remove a cork from a bottle, comprising:

a first screw able to screw into the cork and rotation means associated to said first screw to make said first screw selectively rotate and penetrate into the cork, wherein regulation means are associated to said rotation means for regulating penetration travel of said first screw into the cork according to length of the cork for avoiding said cork being completely perforated by said first screw, said regulation means being also able to be set for obtaining also partial removal of the cork from the bottle;

wherein said rotation means comprises a first electric motor connected to said first screw to command axial displacement thereof;

wherein said rotation means comprises a second electric motor; and wherein said first and second electric motors are assembled coaxial in a single tubular body substantially coaxial to said first screw.

10. The device as in claim 8, wherein said first and second electric motors are assembled coaxial in a tubular body substantially axial to said first screw, wherein said nutscrew is attached inside said tubular body, wherein said second screw is solid with an element mounted axially sliding inside a tube keyed onto said shaft of said first motor, and wherein said element is made to rotate by said tube.

11. The device as in claim 7, wherein said first and second electric motors are assembled in coaxial in a single tubular body substantially coaxial to said first screw, and wherein said connection means comprises a cylindrical element mounted axially sliding inside said tubular body and connected to a second screw to slide axially together therewith, said second motor being attached to said cylindrical element.

12. A device to automatically remove a cork from a bottle, comprising:

a first screw able to screw into the cork and rotation means associated to said first screw to make said first screw selectively rotate and penetrate into the cork, wherein regulation means are associated to said rotation means for regulating penetration travel of said first screw into the cork according to length of the cork for avoiding said cork being completely perforated by said first screw, said regulation means being also able to be set for obtaining also partial removal of the cork from the bottle;

wherein said rotation means comprises a first electric motor connected to said first screw to command axial displacement thereof;

wherein said rotation means comprises a second electric motor; and wherein said regulation means comprise a first micro-switch and a second micro-switch able to selectively command the start, stop and inversion of motion of said first and second electric motors, and an actuator able to selectively activate each of said micro-switches.

13. The device as in claim 12, wherein said actuator comprises a fin connected to said second motor and located between said first and second micro-switches.

14. The device as in claim 12, wherein said first micro-switch is mounted on a stationary structure and wherein said second micro-switch is mounted on a support element selectively positionable with respect to said first micro-switch, defining a distance therebetween, so that the distance between said first and second micro-switches is selectively variable.

15. The device as in claim 1, wherein the bottle includes a neck, covered with a protective cap, and wherein cutting means are provided to circumferentially cut at least a portion of said protective cap.

16. A device to automatically remove a cork from a bottle, comprising:

a first screw able to screw into the cork and rotation means associated to said first screw to make said first screw selectively rotate and penetrate into the cork, wherein regulation means are associated to said rotation means for regulating penetration travel of said first screw into the cork according to length of the cork for avoiding said cork being completely perforated by said first screw, said regulation means being also able to be set for obtaining also partial removal of the cork from the bottle;

wherein said rotation means comprises a first electric motor connected to said first screw to command axial displacement thereof;

wherein said rotation means comprises a second electric motor;

wherein the bottle includes a neck, covered with a protective cap, and wherein cutting means are provided to circumferentially cut at least a portion of said protective cap and wherein a manual actuator is provided to actuate said cutting means, wherein said manual actuator is slidable with respect to the bottle, and wherein a switch is associated to said actuator to cause said first and second electric motors to start.

17. The device as in claim 9, wherein a nutscrew is attached inside said tubular body, wherein a second screw is solid with an element mounted axially sliding inside a tube keyed onto a shaft of said first motor, and wherein said element is made to rotate by said tube.

18. A device to automatically remove a cork from a bottle, comprising:

a first screw able to screw into the cork and rotation means associated to said first screw to make said first screw selectively rotate and penetrate into the cork, wherein regulation means are associated to said rotation means for regulating penetration travel of said first screw into the cork according to length of the cork for avoiding said cork being completely perforated by said first screw, said regulation means being also able to be set for obtaining also partial removal of the cork from the bottle;

wherein the bottle includes a neck, covered with a protective cap, wherein cutting means are provided to circumferentially cut at least a portion of said protective cap, wherein said rotation means comprises a first electric motor connected to said first screw to command axial displacement thereof;

wherein said rotation means comprises a second electric motor; and wherein a manual actuator is provided to actuate said cutting means, wherein said manual actuator is slidable with respect to said bottle, and wherein a switch is associated to said actuator to cause said first and second electric motors to start.

* * * * *